US005390684A

United States Patent [19]

Rizzoli et al.

[11] Patent Number: 5,390,684

[45] Date of Patent: Feb. 21, 1995

[54] ROLLING DEVICE FOR FILTER ASSEMBLY MACHINES

[75] Inventors: Salvatore Rizzoli, Bologna; Fiorenzo Draghetti, Medicina, both of Italy

[73] Assignee: G.D Societa' Per Azioni, Bologna, Italy

[21] Appl. No.: 152,308

[22] Filed: Nov. 12, 1993

[30] Foreign Application Priority Data

Nov. 20, 1992 [IT] Italy ..... B092A 000416

[51] Int. Cl.[6] ..... A24C 5/10; A24C 5/52; A24C 5/47

[52] U.S. Cl. ..... 131/94; 131/32; 131/58

[58] Field of Search ..... 131/29, 32, 94, 84.1, 131/68, 58

[56] References Cited

U.S. PATENT DOCUMENTS 4,149,546 4/1979 Luke et al. ..... 131/94

4,565,202 1/1986 Seragnoli et al. ..... 131/281

FOREIGN PATENT DOCUMENTS 2205477 12/1988 United Kingdom .

*Primary Examiner*—Jennifer Bahr

*Attorney, Agent, or Firm*—Marshall, O'Toole, Gerstein, Murray & Borun

[57] ABSTRACT

On a filter assembly machine, a rolling device provides for joining, by means of a succession of strips, a number of elongated elements in a corresponding succession of groups using a number of rollers, each presenting a respective seat for a respective group, and each rotating about a respective axis for rolling the groups in contact with a rolling surface; the axes of the rollers being moved, in relation to the rolling surface, at a first speed; and the rollers being so operated as to rotate about the respective axes and advance the respective seats at a second variable speed which is minimum when the groups are loaded and unloaded on and off the rollers.

10 Claims, 2 Drawing Sheets

ROLLING DEVICE FOR FILTER ASSEMBLY MACHINES

BACKGROUND OF THE INVENTION

The present invention relates to a rolling device for filter assembly machines.

Currently used filter assembly machines are normally fed by a cigarette manufacturing machine with a succession of double cigarette portions, which are cut in half transversely into two single portions. The single portions in each pair are then parted axially to define in between a gap into which is inserted a double filter which, together with the two single portions, forms a "group" of coaxial elongated elements which are joined together to form a double cigarette.

To form the double cigarettes, a projecting strip of gummed paper is fed on to each group, which strip is slightly longer than the double filter, is positioned centrally on the group, and is wound about the group inside a rolling device.

In general, known rolling devices comprise a rolling drum for successively feeding the groups and respective strips into a rolling channel defined by a fixed plate facing the outer surface of the rolling drum. The plate extends over a relatively small arc—normally of about 60°—of the periphery of the rolling drum, and is detached from the drum by a distance approximately equal to but no greater than the diameter of the double filter. On contacting the plate and by virtue of the friction produced by the plate on one side and the outer surface of the drum on the other, each group is rolled about its axis, thus winding the strip about the double filter and part of the two single portions, and is fed along the rolling channel at a speed equal to half the surface speed of the rolling drum.

Known rolling devices of the aforementioned type present several drawbacks, mainly due to the continually increasing output capacity of filter assembly machines and, hence, continually increasing travelling speed of the groups, the single portions of which tend to break on contacting the input end of the fixed plate, and to spill tobacco as a result of the relatively high rolling speed (roughly 5000 rpm) of the groups as they are fed along the rolling channel.

SUMMARY OF THE INVENTION

It is an object of the present invention to provide a rolling device designed to overcome the aforementioned drawbacks.

According to the present invention, there is provided a rolling device for filter assembly machines, the device comprising a loading station for both a succession of groups of elongated elements, each group comprising a pair of cigarette portions and an intermediate double filter aligned with one another, and a corresponding succession of strips for connecting the pairs of cigarette portions to the respective double filters and forming respective double cigarettes; an unloading station for said double cigarettes; transfer means for feeding said groups and respective strips along a first path extending between said loading and unloading stations; and rolling means defining a rolling surface and located between said loading and unloading stations, for rolling said strips on to the respective groups; characterized by the fact that said transfer means comprise a number of rollers rotating about respective axes and each presenting a peripheral seat for a respective said group; first drive means for moving said rollers along said rolling surface at a first given speed; and second drive means for rotating the rollers about the respective axes, and cooperating with said first drive means for moving the respective seats at a variable speed along a second path through said loading and unloading stations; said second drive means imparting to said rollers a second variable surface speed, which is minimum at said loading and unloading stations.

BRIEF DESCRIPTION OF TEE DRAWINGS

A non-limiting embodiment of the present invention will be described by way of example with reference to the accompanying drawings, in which.

DETAILED DESCRIPTION OF THE INVENTION

Figure 1:
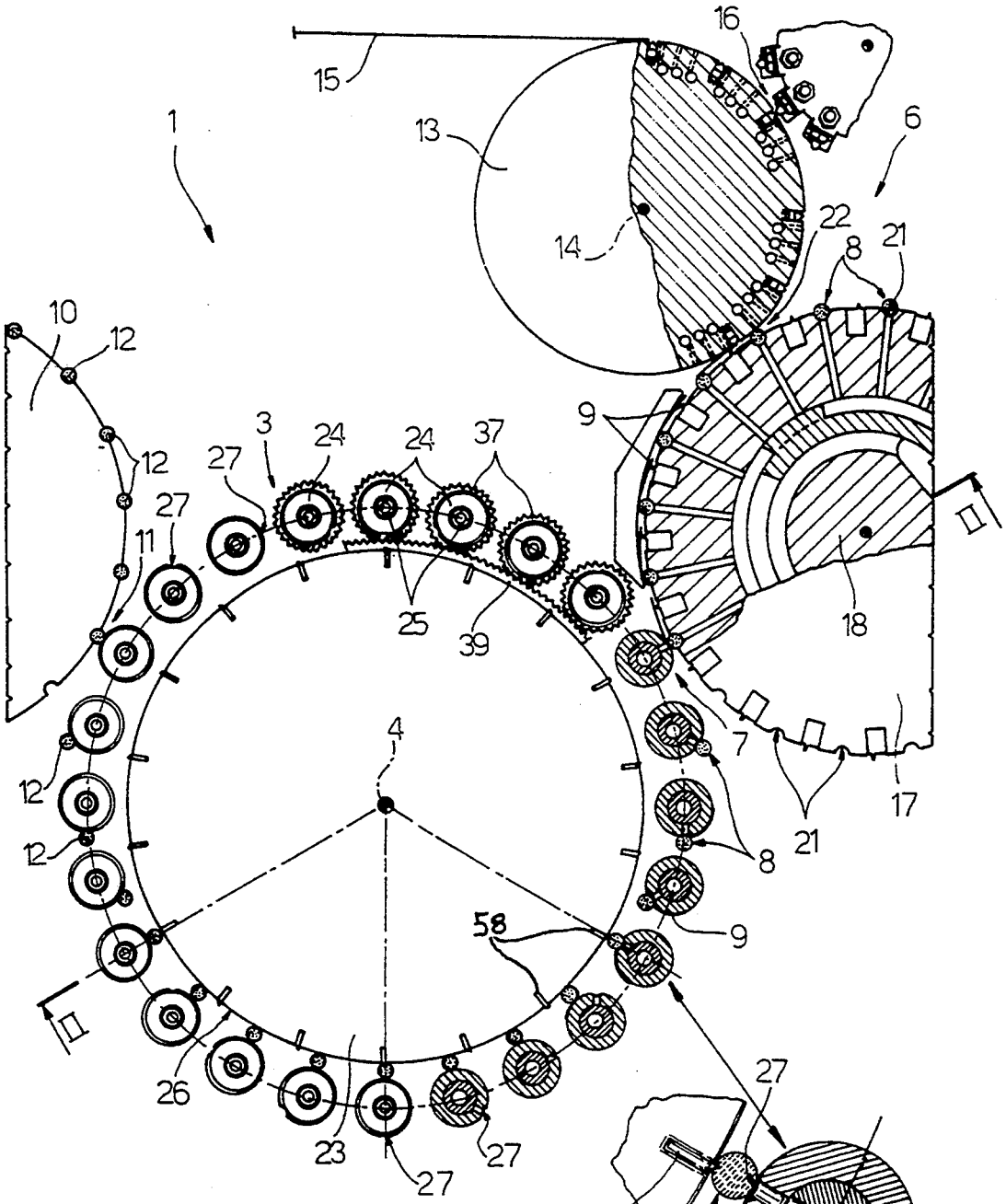
FIG. 1 shows a partial section of a preferred embodiment of the filter assembly machine according to the present invention.
Figure 1A:
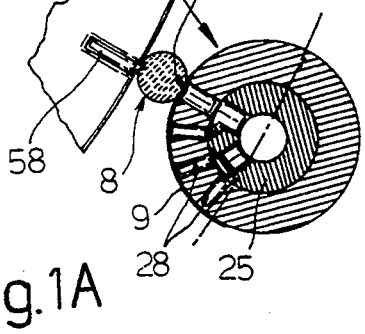
FIG. 1A is an enlarged view of a portion of FIG. 1.

Number 1 in FIG. 1 indicates a filter assembly machine comprising a fixed supporting frame 2 (FIG. 2); and a powered rotary rolling unit 3 with its axis of rotation 4 perpendicular to the FIG. 1 plane, and which is supported on a shaft 5 (FIG. 2) coaxial with axis 4 and connected in rotary and axially fixed manner to frame 2.

Machine 1 also comprises a feed device 6 for successively feeding rolling unit 3, at a loading station 7, with both a number of groups 8, each defined in known manner by two cigarette portions separated by a double filter, and a gummed strip 9 for connecting each cigarette portion to the relative double filter. Machine 1 also comprises a known suction roller 10 tangent to unit 3 at an unloading station 11, and which provides for receiving from unit 3 a succession of double cigarettes 12.

Figure 2:
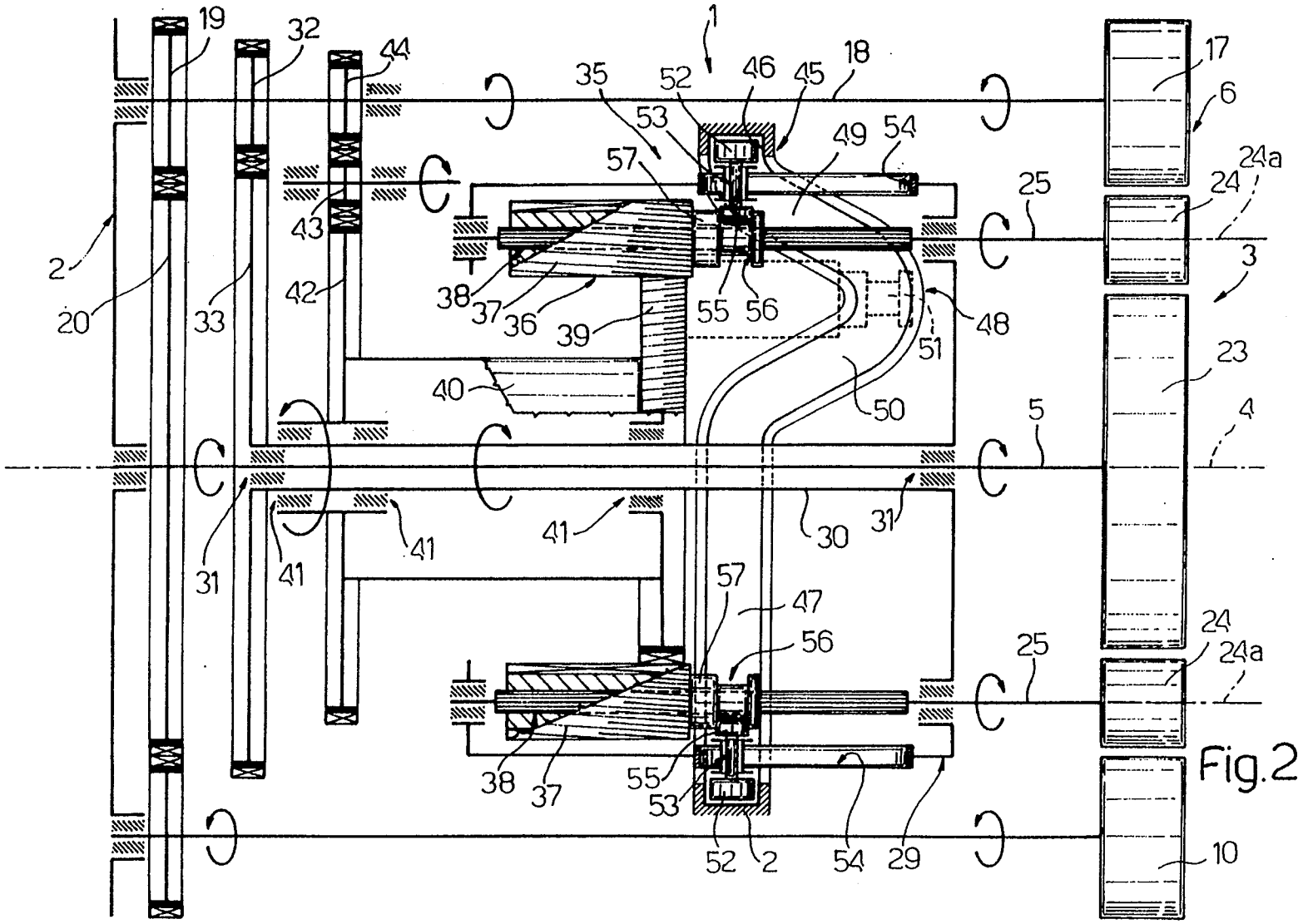
FIG. 2 shows a schematic section along line II—II in FIG. 1, with parts removed for clarity.

Device 6 comprises a first powered suction type input roller 13 parallel to unit 3 and rotating about its axis 14 for feeding a strip 15 of sheet material through a cutting station 16, where strip 15 is gradually cut transversely into a succession of strips 9, and through a gumming station (not shown) where strips 9 are gummed. Device 6 also comprises a second known roller 17 which, as shown in FIG. 2, is fitted on to a supporting shaft 18 connected in rotary manner to frame 2 and parallel to shaft 5, and which is also fitted with a gear 19 meshing with a gear 20 fitted on to shaft 5. As shown in FIG. 1, roller 17 is tangent to rolling unit 3 at station 7, and presents a number of equally spaced peripheral suction seats 21, each designed to receive and retain a respective group 8. Roller 17 is also tangent to roller 13 at a station 22 wherein strips 9 are transferred on to roller 17 and connected in projecting manner to respective groups 8.

As shown in FIG. 1 and particularly in FIG. 2, unit 3 comprises a central roller 23 fitted on to shaft 5 and rotating clockwise (in FIG. 1) in relation to frame 2 at a given surface speed V1; and a ring of planetary rollers 24 having respective axes 24*a* parallel to axis 4, each fitted on to a respective tubular shaft 25, and which are separated from the outer lateral surface 26 of roller 23 by a distance approximately equal to but no greater than the diameter of groups 8.

With reference to FIG. 1, each roller 24 presents a suction seat 27 for partially receiving and retaining a respective group 8; and a number of suction conduits 28 communicating, via radial holes and an axial hole formed in shaft 25, with a suction device (not shown) for retaining strip 9 of respective group 8. Shafts 25 of rollers 24 are connected in rotary and axially fixed manner to a hollow supporting drum 29 (shown only in FIG. 2 for the sake of simplicity) located to the rear of roller 23.

As shown in FIG. 2, drum 29 is fitted on to a tubular shaft 30 fitted through longitudinally with shaft 5 and which is connected in rotary manner to shaft 5 by a pair of supports 31. Drum 29 is connected to shaft 18 by two gears 32 and 33, the first of which is fitted to shaft 18, and the second of which is fitted to drum 29 so as to rotate in relation to frame 2 and clockwise (in FIG. 2) about axis 4, and move shafts 25 about shaft 5 at a speed V2 greater than, and in particular equal to 4/3 of, speed V1.

Planetary rollers 24 are rotated (clockwise in FIG. 1) at a variable speed V3 about respective axes 24*a* and in relation to drum 29 by a drive device 35 (FIG. 2). As shown in FIG. 2, device 35 comprises a gear drive 36 in turn comprising a helical sun gear 39, and, for each roller 24, a helical planetary gear 37 meshing with gear 39 and connected in axially sliding and angularly fixed manner to respective shaft 25 by means of a splined coupling 38. Gear 39 is fitted to the end portion of a sleeve 40 extending coaxially with shafts 5 and 30 and connected in rotary and axially fixed manner to shaft 30 by means of a pair of supports 41. On the opposite end to that fitted with gear 39, sleeve 40 is fitted with a further gear 42 meshing with an intermediate idle gear 43 in turn meshing with a final gear 44 fitted on to shaft 18 and which, together with gears 42 and 43, forms part of device 35.

Again with reference to FIG. 2, device 35 also comprises a cylindrical cam 45 coaxial with axis 4 and defined by a circumferential groove 46 formed inside a portion of frame 2 and presenting two portions 47 (only one shown in FIG. 2) extending between stations 7 and 11 and lying in a flat plane substantially perpendicular to axes 4 and 24*a*, and two portions 48 (only one shown in FIG. 2) projecting in relation to said plane and towards roller 23, and located at stations 7 and 11. More specifically, each portion 48 is substantially V-shaped with its concavity facing gears 37 and 39, and is in turn defined by a first portion-49 and a second portion 50 respectively up- and downstream from relative station 7, 11, and by an intermediate portion 51 connecting portions 49 and 50 and located at relative station 7, 11.

Finally, for each planetary roller 24, device 35 comprises a tappet roller 52 engaging groove 46 in rolling manner and mounted for rotation on a first end of a respective supporting pin 53 extending radially in relation to respective axis 24*a*. Each pin 53 comprises an intermediate substantially rectangular-section portion extending in sliding but angularly fixed manner through a respective guide slot 54 parallel to respective shaft 25 and formed axially through the lateral wall of drum 29. On the inner end opposite that fitted with roller 52, each pin 53 also supports in rotary manner a further roller 55 designed to roll along a respective circumferential groove 56 formed on the outer periphery of a sleeve 57 integral and coaxial with respective gear 37 and extending on the same side of cam 45 as gear 37.

Operation of machine 1 will now be described for the sake of simplicity with reference to one group 8 retained by suction on roller 17 together with a respective strip 9 and fed by roller 17 towards station 7, and with reference to one planetary roller 24 fed towards station 7 at speed V2 by drum 29 and rotated about its axis 24*a* at speed V3.

As of the above condition, upon tappet roller 52 engaging portion 49, pin 53 begins to slide gradually inside slot 54 so as to move gear 37 gradually and axially in relation to gear 39. As a consequence of the above movement, which is permitted by splined coupling 38, speed V2 remains unchanged, while speed V3 is gradually reduced by the reverse rotation imparted to gear 37 by its helical teeth sliding axially in contact with the helical teeth of gear 39, and reaches a minimum value upon tappet roller 52 reaching portion 51 of cam 45. The arrival in station 7 of group 8 and respective strip 9 on roller 17 coincides with both the minimum surface speed of roller 24 and the presence in station 7 of seat 27, which retains group 8 and respective strip 9 by suction and so transfers them from roller 17 to rolling unit 3. As tappet roller 52 advances along portion 50 of groove 46, the surface speed of planetary roller 24 increases gradually, and speed V3 gradually increases until it reaches a rolling value Vr equal to twice speed V1 of roller 23. At this point, planetary roller 24 is so positioned angularly as to present seat 27 facing a tooth 58, one end of which projects slightly from surface 26 and engages the outer periphery of group 8 so as to release it from seat 27. Planetary roller 24 continues rotating about its axis 24*a* at speed Vr, so as to move seat 27 along a first substantially sinusoidal path through stations 7 and 11, while group 8 travels along a second path, the initial portion of which coincides with the initial portion of the first path and extends through station 7, and the intermediate portion of which extends along surface 26. Along the intermediate portion of the second path, group 8, which is forced slightly between surface 26 and planetary roller 24, begins to roll over surface 26 and about its own axis, so as to wind strip 9 gradually about itself.

During the rolling stage, i.e. wherein strip 9 is wound gradually about group 8, planetary roller 24 completes one full turn about its axis 24*a*, and travels, in relation to roller 23, along an arc of substantially 120° with its center at axis 4, so that seat 27 is again positioned facing surface 26, and the double cigarette 12 so formed is transferred to planetary roller 24 by which it is fed along a final portion of the second path coinciding with a final portion of the first path and extending through station 11.

At this point, tappet roller 52, which, during the rolling stage has travelled along portion 47 of cam 45, thus maintaining gears 37 and 39 axially fixed in relation to each other, engages the second V-shaped portion 48 of cam 45 formed at station 11, so that, as at station 7, speed V3 is first reduced to a minimum value at which double cigarette 12 is transferred in known manner to roller 10, and is then increased gradually to the starting value.

We claim:

1. A rolling device for filter assembly machines, the device comprising:

a loading station for both (1) a succession of groups of elongated elements, each group including a pair of cigarette portions and an intermediate double filter aligned with one another, and (2) a corresponding succession of strips for connecting the pairs of cigarette portions to the respective double filters and forming respective double cigarettes;

an unloading station for the double cigarettes;

transfer means for feeding said groups and respective strips along a first path extending between said loading and unloading stations; and rolling means defining a rolling surface and located between said loading and unloading stations for rolling said strips on to the respective groups;

said transfer means including a plurality of rollers rotating about respective axes and each presenting a peripheral seat for a respective said group; first drive means for moving said rollers along said rolling surface at a first given speed; and second drive means for rotating the rollers about the respective axes and cooperating with said first drive means for moving the respective seats at a variable speed along a second path through said loading and unloading stations; said second drive means imparting to said rollers a second peripheral speed which varies between a minimum and a maximum as the rollers travel along said rolling surface; the second speed of each roller being at its minimum when the roller is at said loading and unloading stations.

2. A device as claimed in claim 1, including third drive means for advancing said rolling surface at a third given speed; said first drive means being designed to feed said rollers in the same direction as the rolling surface and at a fourth speed greater than said third speed.

3. A device as claimed in claim 2, wherein said fourth speed is substantially equal to four-thirds of said third speed.

4. A device as claimed in claim 3, wherein said second speed, when at its maximum, is substantially equal to twice said third speed.

5. A device as claimed in claim 2, wherein the outer periphery of each of said rollers defines with the rolling surface a rolling passage for a respective said group.

6. A device as claimed in claim 5, including fixed frame means; and a powered central roller connected to the fixed frame means and rotating in a given direction about its axis and in relation to the fixed frame means; said rolling surface being defined by the outer lateral surface of said central roller; said third drive means being connected to said central roller for imparting to it a peripheral speed equal to said third speed; and said rollers being planetary rollers arranged in a ring about said central roller.

7. A device as claimed in claim 6, including movable frame means for supporting said planetary rollers; said first drive means being connected to said movable frame means for rotating the movable frame means about said axis and for imparting to the axes of said planetary rollers said fourth speed.

8. A device as claimed in claim 7, wherein said movable frame means support in rotary manner a number of shafts, each fitted with a respective said planetary roller; said second drive means including a first helical drive gear and, for each said planetary roller, a second helical gear meshing with said first gear and mounted in sliding and angularly fixed manner on a respective said shaft; actuating means being provided for moving each said second gear axially along the respective said shaft and in relation to the first gear and for imparting a corresponding additional rotational movement to the respective said planetary roller.

9. A device as claimed in claim 8, wherein said actuating means includes a fixed cam; and, for each said gear, a tappet element moved along the fixed cam by said first drive means.

10. A device as claimed in claim 9, wherein said fixed cam is so formed as to impart a reverse said additional rotational movement to each planetary roller as the planetary roller travels through said loading and unloading stations.

* * * * *